US005526783A

United States Patent [19]

Ito et al.

[11] Patent Number: 5,526,783

[45] Date of Patent: Jun. 18, 1996

[54] LUBRICANT CONTROL

[75] Inventors: Hideaki Ito; Kohsei Maebashi; Makoto Kosugi; Hidenori Suhara, all of Iwata, Japan

[73] Assignee: Yamaha Hatsudoki Kabushiki Kaisha, Iwata, Japan

[21] Appl. No.: 84,300

[22] Filed: Jun. 28, 1993

[30] Foreign Application Priority Data

Jun. 29, 1992 [JP] Japan ..... 4-196607
Apr. 5, 1993 [JP] Japan ..... 5-078339

[51] Int. Cl.[6] ..... F01M 3/02

[52] U.S. Cl. ..... 123/196 S; 123/73 AD; 184/7.4

[58] Field of Search ..... 123/196 R, 196 S, 123/73 AD; 184/7.4

[56] References Cited

U.S. PATENT DOCUMENTS

| | | |
|---|---|---|
| 2,253,152 | 8/1941 | Towler et al. . |
| 2,796,075 | 6/1957 | Focht . |
| 3,302,752 | 2/1967 | Shikawa . |
| 3,396,151 | 8/1983 | Kato et al. . |
| 3,435,612 | 4/1969 | Hensler . |
| 3,447,636 | 6/1969 | Bonfilio . |
| 3,779,225 | 12/1973 | Watson et al. . |

(List continued on next page.)

FOREIGN PATENT DOCUMENTS

| | | |
|---|---|---|
| 0275715 | 12/1987 | European Pat. Off. . |
| 0376815 | 12/1989 | European Pat. Off. . |
| 0381162 | 8/1990 | European Pat. Off. . |
| 1400280 | 4/1965 | France . |
| 949855 | 9/1956 | Germany . |
| 2411513 | 9/1975 | Germany . |
| 3025002 | 2/1981 | Germany . |
| 3909772 | 3/1989 | Germany . |
| 57-16212 | 1/1982 | Japan . |
| 59-96411 | 6/1984 | Japan . |
| 62-131908 | 6/1987 | Japan . |
| 1-04711 | 2/1988 | Japan . |
| 64-45912 | 2/1989 | Japan . |
| 1-92505 | 4/1989 | Japan . |
| 2-191807 | 7/1990 | Japan . |
| 2-118111 | 9/1990 | Japan . |
| 2-118110 | 9/1990 | Japan . |
| 2139307 | 11/1990 | Japan . |
| 2151313 | 7/1985 | United Kingdom . |
| 2167124 | 5/1986 | United Kingdom ..... 123/73 AD |
| 2198191 | 8/1988 | United Kingdom . |

OTHER PUBLICATIONS

European Search Report dated Mar. 4, 1993; Patent Abstracts of Japan vol. 9, No. 231 (M414) (1954) 18 Sep. 1985 & JP–A–60 88 811 (Sanshin Kohyo K.K.) 18 May 1985 *Abstract*.

European Search Report dated Jun. 19, 1992; Patent Abstract of Japan, vol. 12, No. 121, 15 Apr. 1988 & JP–A–62 248 812 19 Oct. 1987.

European Search Report dated Oct. 19, 1992.

Pat. Abs. of Japan vol. 12, No. 121 (M686) (2968) 15 Apr. 1988 & JP–A–2 248 812 (Nippon soken Inc) 29 Oct. 1987 & Pat. Abs. of Japan vol. 10, No. 204 (M499).

(2260) 17 Jul. 1986 & JP–A–61 46 409 (Mazda Motor Corp.) 6 Mar. 1986 and European Search Report dated Mar. 31, 1993.

*Primary Examiner*—Erick R. Solis

*Attorney, Agent, or Firm*—Knobbe, Martens, Olson & Bear

[57] ABSTRACT

Embodiments of lubricating systems and methods for two cycle, crankcase compression, diesel engines wherein certain running components of the engine such as the crankshaft and pistons are each supplied with their own lubricating systems including independently operating lubricating pumps, each system is controlled so as to supply a finite amount of lubricant to the engine and then sense the engine running conditions to determine when the lubricant will have been consumed before additional lubricant is supplied. In addition, a control routine and structure is disclosed wherein lubrication is supplied to the engine before starting is initiated and wherein the amount of lubrication supplied is varied during break-in.

83 Claims, 12 Drawing Sheets

U.S. PATENT DOCUMENTS

| | | | |
|---|---|---|---|
| 3,938,425 | 2/1976 | Kroffke . | |
| 4,094,293 | 6/1978 | Evans . | |
| 4,199,950 | 4/1980 | Hakanson et al. . | |
| 4,286,632 | 9/1981 | Abel . | |
| 4,369,743 | 1/1983 | Holt et al. | 123/196 S |
| 4,385,614 | 5/1983 | Eheim et al. . | |
| 4,446,833 | 5/1984 | Matsushita et al. . | |
| 4,452,188 | 6/1984 | Kosuda et al. . | |
| 4,480,602 | 11/1984 | Kobayashi et al. . | |
| 4,506,337 | 3/1985 | Yasuhara | 123/196 S |
| 4,512,298 | 4/1985 | Bayashi . | |
| 4,531,485 | 7/1985 | Murther | 123/196 S |
| 4,533,301 | 8/1985 | Foster . | |
| 4,539,949 | 9/1985 | Walsworth . | |
| 4,551,076 | 11/1985 | Dubois . | |
| 4,563,988 | 1/1986 | Weishaupt | 123/196 S |
| 4,655,183 | 4/1987 | Taira et al. . | |
| 4,697,553 | 10/1987 | Lie . | |
| 4,706,193 | 11/1987 | Imajo et al. | 123/196 S |
| 4,715,791 | 12/1987 | Berlin et al. . | |
| 4,726,330 | 2/1988 | Shiga . | |
| 4,758,130 | 7/1988 | Waterworth . | |
| 4,829,967 | 5/1989 | Nuti . | |
| 4,875,551 | 10/1989 | Lulich | 123/196 S |
| 4,887,559 | 12/1989 | Hensel et al. . | |
| 4,893,598 | 1/1990 | Stasuik . | |
| 4,904,163 | 2/1990 | Tachi et al. . | |
| 4,944,658 | 7/1990 | Buttner . | |
| 4,967,700 | 11/1990 | Torigai . | |
| 4,989,555 | 2/1991 | Matsuo et al. . | |
| 5,020,484 | 6/1991 | Ishikawa et al. . | |
| 5,052,355 | 10/1991 | Ito et al. | 123/73 AD |
| 5,069,177 | 12/1991 | Dokonal | 123/196 S |
| 5,094,196 | 3/1992 | Tsuurtani et al. | 123/73 AD |
| 5,147,014 | 9/1992 | Pederson | 123/196 S |
| 5,156,120 | 10/1992 | Kent | 123/196 S |
| 5,195,476 | 3/1993 | Schwarz | 123/196 S |
| 5,197,424 | 3/1993 | Blum | 123/196 S |
| 5,235,944 | 8/1993 | Adachi . | |

LUBRICANT CONTROL

BACKGROUND OF THE INVENTION

This invention relates to a lubricant control and more particularly to an improved lubricant control system and method for an internal combustion engine.

The lubrication of an internal combustion engine is particularly important, as should be readily apparent. However, the problems of providing adequate lubrication during the widely varying engine speeds and loads encountered during normal operation, particularly in automotive applications, is particularly difficult. This problem is particularly acute in conjunction with two cycle engines since the spent lubricant is discharged with the exhaust gases from the engine. Hence, if excess lubricant is employed, the exhaust emission problems can become acute and also particulates in the exhaust gases may become objectionable in the form of smoke. However, if inadequate lubrication is supplied, then disastrous results will occur.

It has, therefore, been proposed to eliminate the previously proposed method of lubricating two cycle engines by mixing lubricant with their fuel to provide positive lubricating systems that deliver lubricant directly to the engine for its lubrication. These systems may either inject lubricant into the intake passage or may deliver the lubricant directly to the components of the engine to be lubricated. Although these systems have particular advantages, they do present substantial problems.

Specifically, the amount of lubricant required for the engine per cycle varies substantially with load and speed and it is difficult to provide adequate and yet not excessive lubricant under all running conditions. In addition, although steady state conditions can be relatively easily satisfied, most engine applications do not afford any significant time of steady state running and accommodating transient conditions is quite difficult.

One form of lubricating system that has been provided introduces a fixed amount of lubricant at periodic time intervals. The amount of lubricant supplied is generally set larger as the engine load increases and the period between the supply intervals is set shorter as the engine speed increases. However, this type of system presents certain difficulties under certain types of running conditions such as high load, low speed operation. If this running condition is accommodated, then the satisfaction of the high load, high speed requirements is difficult to obtain.

One type of system has been proposed wherein the amount of lubricant supplied per cycle is fixed and the oil supply interval is varied in response to engine running conditions in the normal operating range. However, under high speed, high load conditions the oil supply interval is fixed and the amount of oil supplied per cycle is varied. Again, however, this type of system still has difficulty in accommodating transient conditions.

It is, therefore, a principal object to this invention to provide an improved lubricating system and method for an internal combustion engine.

It is a further object to this invention to provide an improved lubricating system and method for an engine, particularly of the two cycle type, that will accommodate all running conditions including transient conditions without introducing undesirable exhaust gas emissions or inadequate lubrication.

Most lubricating systems for engines also are designed so as to operate only when the engine is operating. These systems frequently employ pumps that are driven by the engine and hence when the engine is not running, no lubricant will be supplied. It is well known that a large amount of engine wear is the result of inadequate lubrication during the starting operation.

It is, therefore, a still further object to this invention to provide an improved lubricating system and method for an internal combustion engine wherein lubricant is supplied to the engine automatically before it is started.

With internal combustion engines there are a wide number of components that must be lubricated, even with two cycle engines. The lubricant requirement for the different elements of the engine do not vary in the same proportion, however, with respect to changed speed and load. Most lubricating systems proposed do accommodate variations in the amount of lubricant supplied to the components of the engine, but they cannot cope with the fact that the lubricant requirements for the various components do not vary in the same proportion in response to change in the engine running conditions.

It is, therefore, a still further object to this invention to provide an improved method and system for lubricating the various components of an engine which will insure that all components receive the proper amount of lubricant regardless of the running condition.

Many types of lubricating systems for engines operate by sensing engine running parameters and then varying the amount of lubricant supplied to the engine in response to the sensed parameters. Such devices can, as aforenoted, provide good lubrication and also good lubricant and emission control. However, the amount of lubricant required by the components of the engine varies not only in response to the engine running condition but also the time or life of the engine. For example, during initial break-in a greater amount of lubricant is required then once the engine has been broken in. However, conventional system do not accommodate these variations.

It is, therefore, a still further object to this invention to provide an improved lubricating system and method wherein the lubricant amount is varied not only in response to running conditions but also to the life of the engine.

SUMMARY OF THE INVENTION

A first feature of this invention is adapted to be embodied in a lubricating system and method for an internal combustion engine that comprises an intermittedly operated lubricant pump for pumping a predetermined amount of lubricant per cycle of pump operation. Means are providing for delivering lubricant from the pump to the engine. Sensing means sense the engine running conditions for determining the amount of lubricant consumed by the engine.

In accordance with an apparatus for performing this phase of the invention, control means operate the pump to deliver a fixed amount of lubricant to the engine and thereafter discontinue the operation of the pump until the sensed engine running conditions accumulated over a period of time indicate that lubricant delivery is again required inasmuch as the previously supplied amount of lubricant will have been consumed.

In accordance with a method of practicing the invention embodying a structure as aforedescribed, the pump is operated so as to supply a fixed amount of lubricant to the engine and the pump operation is thereafter discontinued. The running conditions of the engine are sensed during successive time periods and the amount of lubricant consumed during these time periods is thus calculated and accumulated. After the amount of lubricant delivered previously by the pump has been consumed as determined by the aforenoted calculation, the lubricant pump is again operated so as to supply another predetermined amount of lubricant to the engine.

A further feature of the invention is adapted to be embodied in a lubricating system and method for an internal combustion engine that has lubricant delivery means for delivering lubricant to the engine and starting means for starting the engine.

In accordance with an apparatus performing this facet of the invention, the lubricant delivery means is operated to deliver lubricant to the engine prior to operation of the starting means.

In accordance with a method of practicing the invention with the aforedescribed structure, the lubricant delivery means is operated before the starting means is operated so as to insure that the engine will be supplied with lubricant prior to starting.

Another feature of the invention is adapted to be embodied in a lubricating system and method for an internal combustion engine that comprises a lubricant delivery system for supplying lubricant to the engine, sensing means for sensing engine running conditions and timer means for sensing the time during which the engine has operated.

In accordance with a structure for performing this facet of the invention with an apparatus as aforedescribed, control means control the supply of lubricant to the engine in response to both sensed engine running conditions and sensed time of running.

In accordance with a method for practicing the invention in accordance with an apparatus of the type aforedescribed, the amount of lubricant supplied to the engine is varied in response to both sensed engine running conditions and sensed time of running.

A further feature of the invention is adapted to be embodied in a lubricating system and method for an internal combustion engine having first and second operating elements. First and second lubricating systems deliver lubricant to the first and second elements, respectively. Means are provided for sensing engine running conditions.

In accordance with an apparatus for practicing this facet of the invention, first control means control the first lubricating system in response to sensed engine conditions and independently of the second lubricating system. Second control means control the second lubricating system in response to sensed engine conditions and independently of the first lubricating system.

In accordance with a method of practicing the invention with an apparatus of the type aforedescribed, the first and second lubricating systems are controlled independently of each other in response to the sensed engine conditions.

DETAILED DESCRIPTION OF THE PREFERRED EMBODIMENTS OF THE INVENTION

Figure 1:
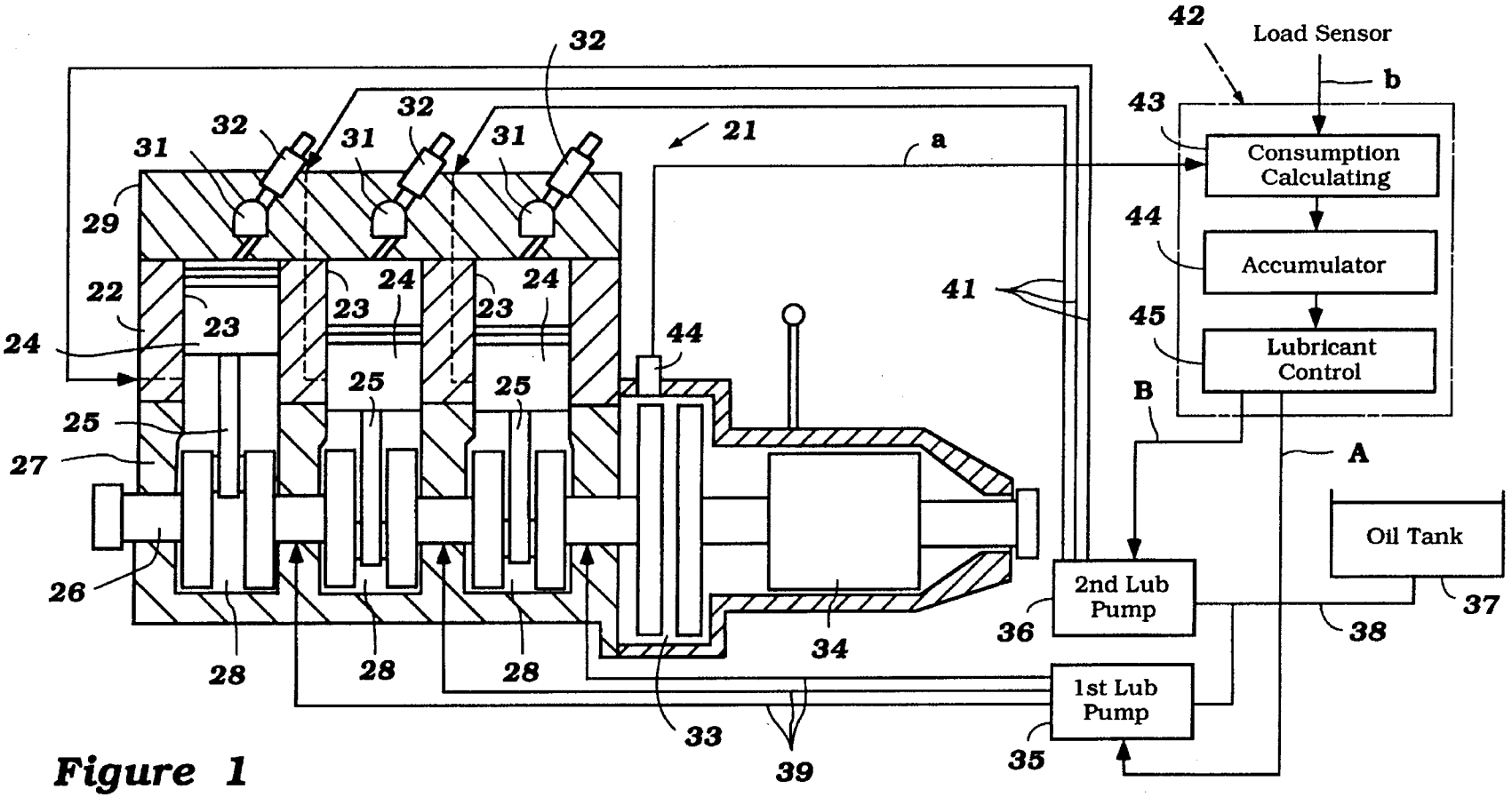
FIG. 1 is a partially schematic cross sectional view taken through the cylinders of an engine that is adapted to be constructed and operated in accordance with the embodiments of the invention.

Referring now in detail to the drawings and initially to FIG. 1, a two cycle, crankcase compression, three cylinder, diesel engine constructed and operated in accordance with the embodiments of the invention is identified generally by the reference numeral 21. Although the invention is described in conjunction with a three cylinder, diesel engine, it is to be understood that the invention may be practiced with engines having other cylinder numbers and other configurations and also with engines that operate on spark ignition rather than on the diesel principal. In addition, although the invention has particularly utility in conjunction with two cycle engines, certain facets of the invention may also be employed with engines operated on the four stroke principal. However, the invention has particularly utility with two cycle engines for reasons which will be obvious to those skilled in the art.

The engine 21 has a cylinder block 22 with three aligned cylinder bores 23. Pistons 24 are supported for reciprocation within the cylinder bores 23 and are connected by means of connecting rods 25 to a crankshaft 26. The crankshaft 26 is rotatably journalled within a crankcase member 27 that is affixed in any well known manner to the cylinder block 22. As is typical with two cycle, crankcase compression engines, the crankcase 27 is divided into three crankcase chambers 28, one for each cylinder, each of which is sealed relative to the others in a suitable manner. An air charge is delivered to the crankcase chambers 28 through a suitable induction system (not shown).

A cylinder head 29 is affixed to the cylinder block 22 in a known manner and defines with the cylinder bores 23 and pistons 24 a combustion chamber. In addition, pre-combustion or torch chambers 31 are also formed in the cylinder head 29. The air charge which has been compressed in the crankcase chambers 28 is transferred to the combustion chamber and pre-chambers 31 through scavenge passages (not shown). Fuel injectors 32 are mounted in the cylinder head 39 and discharge into the pre-chambers 31 for initiating combustion, as is well known in the diesel field. The charge then burns and expands to drive the pistons 24 downwardly and drive the crankshaft 26 in a well known manner. The burnt charge is expended through exhaust ports (not shown) and into a exhaust system of any known type.

At one end of the crankshaft 26 there is disposed a clutch assembly 33 which drives a transmission 34 in a well known manner. The engine 21 except for its lubricating system, clutch 33 and transmission 34 may be considered to be conventional and since these components themselves form no part of the invention, further description of them is believed to be unnecessary.

The invention deals with the lubricating system for the engine 21 as will now be described and certain components of which are shown schematically in FIG. 1. The lubrication system comprises a first lubricant pump 35 which, unlike prior art devices, is driven by its own power source such as an electric pulser motor or the like and a second, similarly driven lubricant pump 36. The first and second lubricant pumps 35 and 36 draw lubricant from a tank 37 through a conduit 38 in which a filter (not shown) is provided.

The first lubricant pump 35 supplied lubricant through a series of conduits 39 to the main bearings of the crankshaft 26 as shown by the arrows. The second lubricant pump 36 delivers lubricant to other elements of the engine and specifically the skirts of the pistons 24 and the piston pins which connect the pistons 24 to the connecting rods 25 through a series of supply lines 41. As will be described later, the oil requirements of the main bearings of the engine are not the same as those for the pistons 24 and piston pins and these requirements do not even vary with load and speed in the same relationship. Hence, the system provides separate lubricant pumps and supply circuits for those portions of the engine which have different lubricant requirements which vary differently with speed and load.

The amount of lubricant supplied to the engine 21 by the lubricant pumps 35 and 36, respectively, is controlled by controlling the output of each of the pumps 35 and 36. The pumps 35 and 36 are positive displacement pumps but have their stroke varied in a suitable fashion, as is well known in this art. In conjunction with the first embodiment of the invention, as to be described, the stroke of the lubricant pumps 35 and 36 is held constant. However, in conjunction with the second embodiment to be described, this stroke or capacity will be varied. In addition, the amount of lubricant supplied is controlled by varying the time interval between the cycles when the pumps 35 and 36 are operated. The operation of the pumps 35 and 36 is controlled by a controller, indicated generally by the reference numeral 42, which outputs control signals "A" and "B" to the pumps 35 and 36, respectively, so as to control their time of operation and also, where the embodiment so requires, their displacement per cycle.

The control 42 includes a number of components including a consumption calculating unit 43 which includes a map which has been preprogrammed in response to engine running variables so as to provide an indication of the amount of lubricant required by each of the main bearings of the crankshaft 26 and the pistons 24 and piston pins in relation to the sensed parameters. In the illustrated embodiments, these sensed parameters are engine speed as determined by a pulser coil 44 that is positioned in proximity to the flywheel of the clutch 33 and which outputs a speed signal "a" to the consumption calculator 43 of the control 42. In addition, a load signal "b" is also transmitted and this load signal is derived by something which provides an indication of load such as the amount of fuel injected by the fuel injectors 32, the intake air amount, throttle valve opening, etc.

The consumption calculator 43 outputs a signal which indicates the amount of lubricant consumed in a given time unit, which may be one revolution of the crankshaft 26 or which may be an actual time interval and outputs this signal to an accumulator 44 which sums the consumption figures to provide a total quantity "Q" or "R" signal indicative of the actual amount of lubricant consumed by the engine. This signal is then outputed to a lubricant control unit 45 which operates in accordance with either of the embodiments, which will be described, so as to control the operation of the pumps 35 and 36.

In connection with the description of the operation of the pumps 35 and 36, it should be noted that the control 45 is provided with three dimensional maps which indicate the requirements of the engine for lubrication at all speeds and loads. The crankshaft journal requirements per rotation may be expressed as "q", while the piston and piston pin requirements per rotation may be expressed as "r". Obviously these requirements increase with respect to engine speed but not necessarily linearally or in the same proportion. As a practical matter, the ratio "S=r/q is set so that it becomes smaller as the engine load and speed increases. This is because the lubrication requirements for the crankshaft increase at a more rapid rate than those for the pistons and pistons pins. Of course, the exact ratios will depend upon the given engine and although the illustrated embodiment refers to lubrication separately of the pistons and crankshaft journals, any other components of the engine may also be similarly lubricated.

The accumulator 43 accumulates the sum of the individual requirements "q" and "r" in accordance with the following relationship:

$$Q=\Sigma_q$$

$$R=\Sigma_r$$

The first and second lubricant pumps 35 and 36, in accordance with a the first embodiment of the invention as aforenoted, output a constant amount of lubricant during each cycle of operation and these amounts are indicated as "$P_q$" and "$P_r$", respectively.

Figure 2:
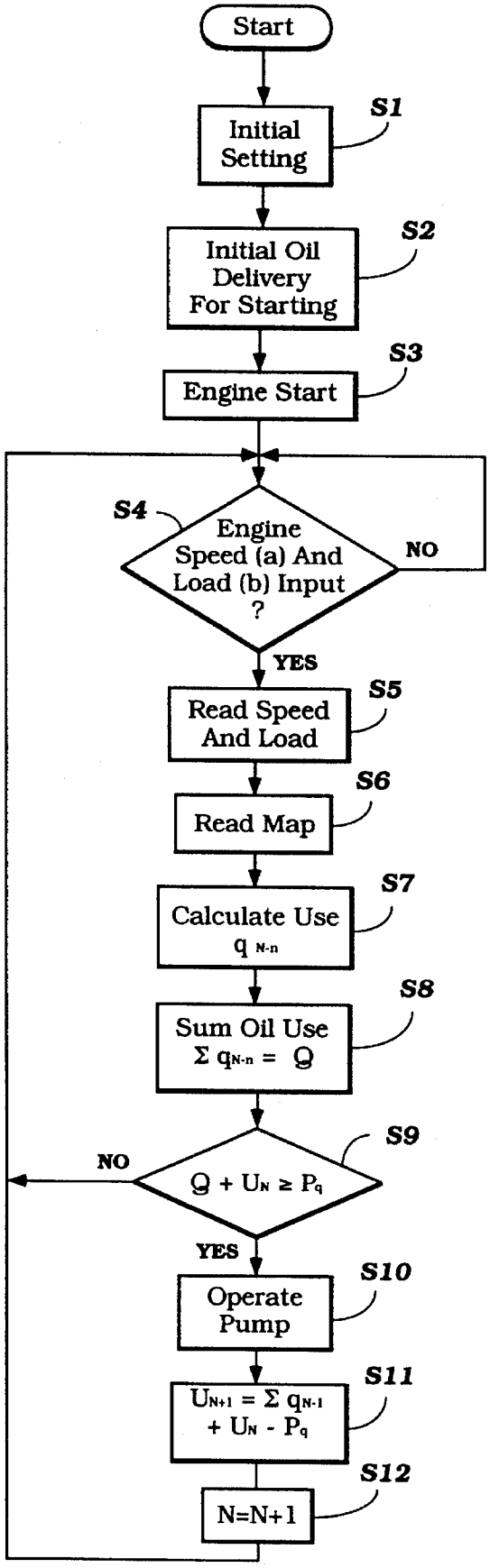
FIG. 2 is a block diagram showing the control routine in accordance with a first embodiment of the invention.

The control routine for a first embodiment of the invention is illustrated in FIG. 2 and will now be described by particular reference to that Figure as well as to FIGS. 3 and 4. Basically, the way the system operates is to supply an amount of lubricant to the engine 21 by operating the respective pumps 35 and 36 for a preset time interval before the engine is started. Once the engine starts and begins running, it running conditions are monitored and the amount of oil consumed during successive intervals is noted and accumulated in a memory until the amount consumed is equal to the amount originally supplied and then a further amount of lubricant is supplied and this program continues to repeat along this sequence. It should be understood that the system for operating each of the first and second lubricant pumps 35 and 36 is the same and the lubricant system only for the crankshaft journals "Q", "q" will be described by particular reference to FIGS. 2 through 4 since it is believed to be obvious from this description to those skilled in the art how to practice the invention in conjunction with the lubrication system for the pistons and piston pins "R", "r".

Figure 3:
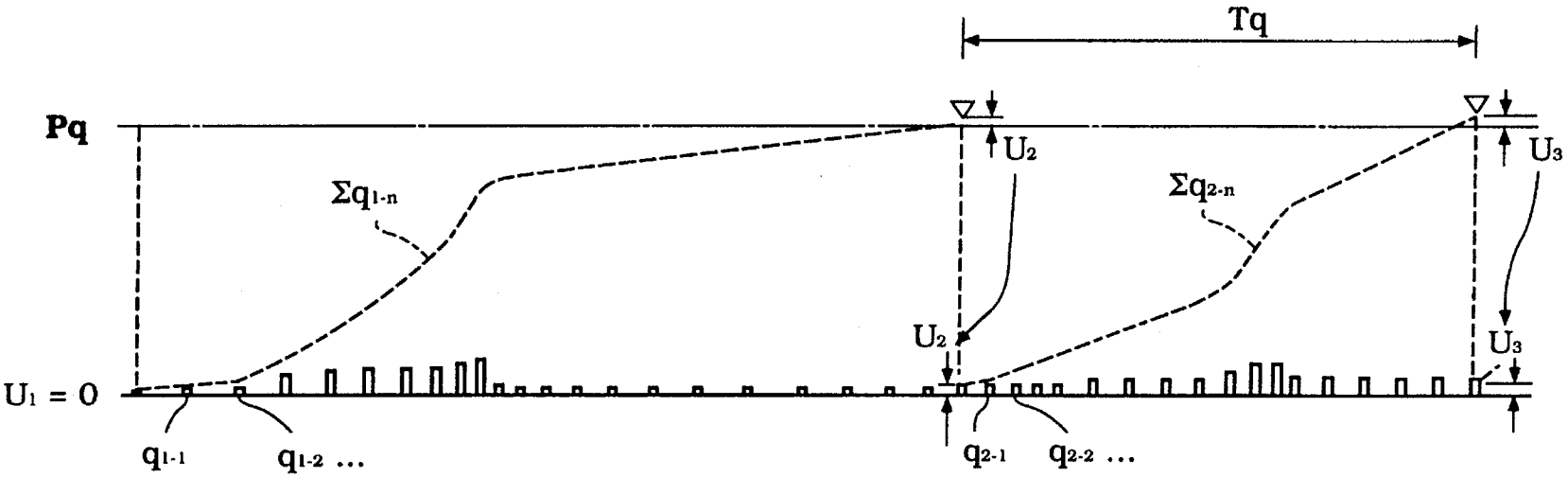
FIG. 3 is a graphical view showing how the lubricant delivery is controlled in response to time or number of engine revolutions.
Figure 4:
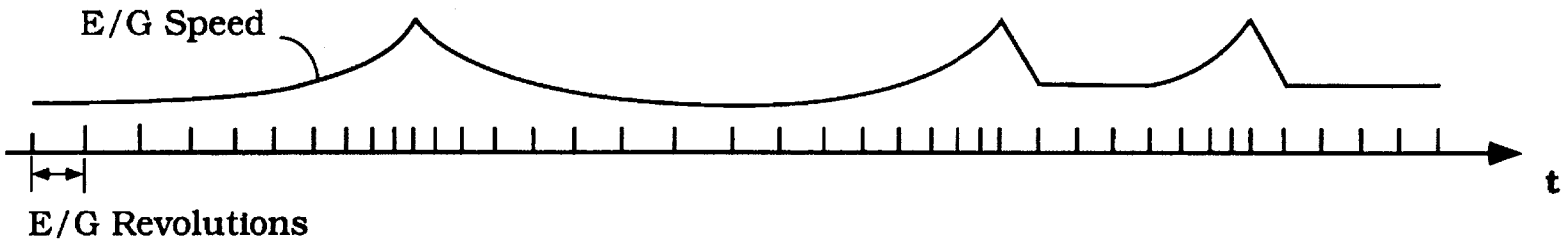
FIG. 4 is a graphically view, in part similar to FIG. 3, and shows the range of engine speed variations with respect to time or number of engine revolutiond so as to relate with the graph of FIG. 3.

The control routine of FIG. 2 may also be best understood by references to FIGS. 3 and 4 which show, respectively, the procedure whereby the oil consumption per revolution or per unit of time is measured in relation to variations in engine speed and how the pump 35 is actuated so as to supply the requisite amount of lubricant for the engine operation. FIG. 4 indicates that the speed varies with the time and/or on successive rotations of the engine so as to depict a real world situation and also so as to show how the system accommodates for transient conditions. In FIG. 3, the amount of lubricant supplied is shown by the line "$P_q$" and the individual consumptions at each engine revolution are indicated by the numbers "$q_{1-1}$" to "$q_{1-n}$" for the first cycle and "$q_{2-1}$" through "$q_{2-n}$" for the subsequent cycle with the time between the completion of the second pump delivery and the next succeeding pump delivery indicated as the time "$T_q$".

Referring now specifically to FIG. 2, the program starts when the ignition key is first turned on and before the starter for the engine 21 is engaged. The program then moves to the step S1 so as to provide an initial setting for the sum of the oil unconsumed and remaining in the engine "U" which in the case of starting, is equal to zero ($U_1$=0). The program then moves to the step S2 wherein the lubricant control 45 operates the first lubricant pump 35 so as to deliver a finite and predetermined amount of lubricant to the engine for starting. As has been noted, in this embodiment the output of the first lubricant pump 35 per cycle is constant and not varied and hence, the pump may be operated through several cycles so as to provide the desired amount of lubricant for starting. This amount is indicated in FIG. 3 as "$P_q$". The program then moves to the step S3 so as to commence the engine starting operation.

The program then moves to the step S4 so as to read the engine speed "a" and load "b" at either a given time interval or for each engine revolution. If there is no input as yet at the step S4, the program repeats back.

If at the step S4 the engine speed and engine load inputs have been received, then the engine speed and load are calculated within the calculator section 43 of the controller 42. The program then moves to the step S6 so as to read the necessary map to determine at the step S7 the amount of oil being consumed for the then read engine speed and load, so as to read the incremental oil consumption "$q_{N-n}$" for the given step "n". The program then moves to the step S8 so as to add the incremental lubricant use calculations from the step S7 so as to provide a sum of the amount of lubricant consumed by the engine during the running period being measured. As may be seen from FIGS. 3 and 4, the lubricant usage varies with engine speed and engine load and the summation curve adds these lubricant amounts per time period measured or per number of engine revolutions as clearly shown by the broken line curve.

The program then moves to the step S9 so as to add the amount of lubricant consumed by the engine during this cycle "Q" to the lubricant carry over requirement "$U_N$". The lubricant carry over requirement is computed at the step S11, as will be described. However, during the initial first cycle of operation "N=1", "$U_N$" has been set to zero (0) at the step S1. This sum is then compared with the amount of lubricant pumped by the pump per cycle of operation "$P_q$". If the sum is not at least equal to "$P_q$", the program repeats to the step S4.

If, however, at the step S9 it has been determined that the sum of the lubricant consumed and the carry over requirement is greater than or equal to the amount of lubricant pumped by the pump per cycle of operation, the program moves to the step S10 so as to operate the pump and deliver another amount of lubricant "$P_q$".

The program then moves to the step S11 to set a new residual lubricant amount "$U_{N+1}$" which amount is equal to the sum of the individual lubricant requirements "$\Sigma_{qN-n}+U_N-P_q$". The program then adds a unit to the cycle number "N" at the step S12, "N=N+1" and then repeats back to the step S4.

As a result of this operation it will be seen that when the engine is operating at low speeds and low loads, the time period for pumped delivery will be relatively long, but at high speeds, high loads the time between oil deliveries becomes shorter and hence the pump and lubrication operation more closely follow the transient conditions. Also since the lubricant is supplied directly to the parts being lubricated rather than to the induction system, lubricant will not remain in the intake passages or the like and the amount of lubricant supplied can be reduced to a minimum and exhaust emission control is improved as is oil consumption.

FIGS. 5 through 16 show another embodiment of the invention which is generally similar to the previously described embodiments and employs a structure as shown in FIG. 1. However, with this embodiment not only the time interval between successive pump operations is varied but also the displacement of the output of each of the pumps 35 and 36 may be varied. This may be accomplished in any known manner.

Figure 5:
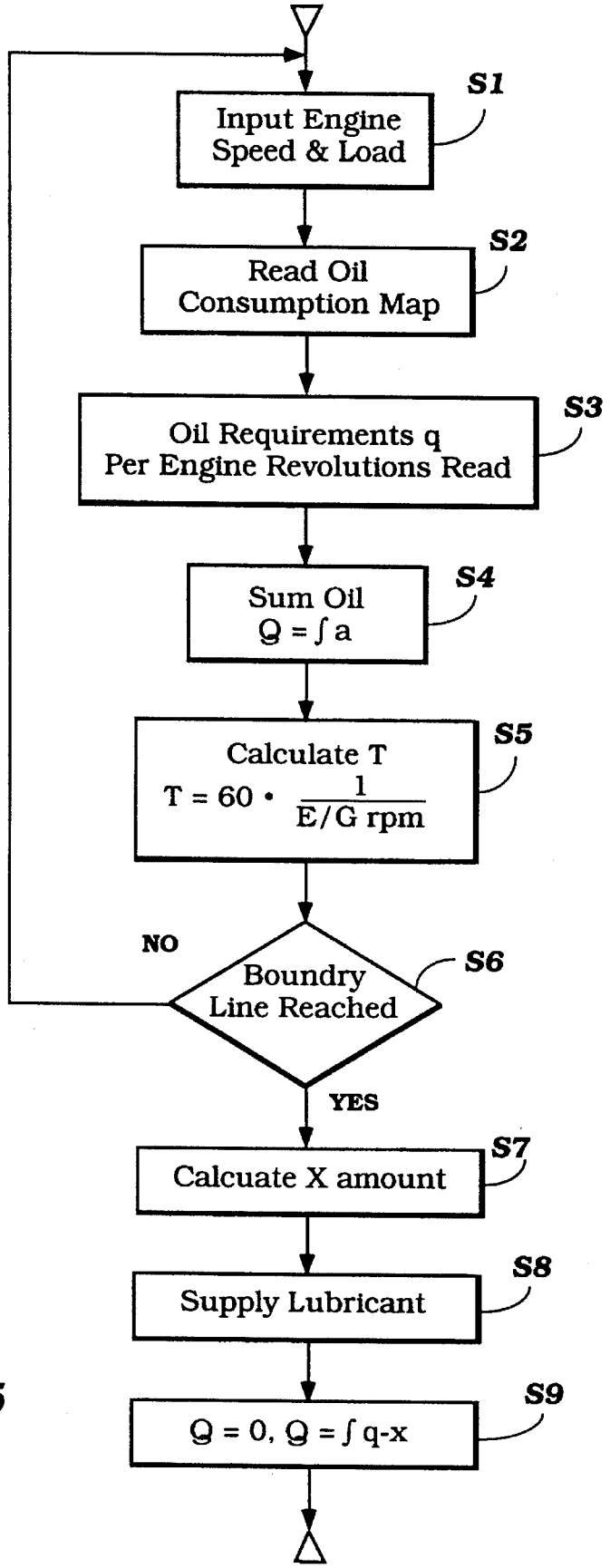
FIG. 5 is a block diagram of a control routine, in part similar to FIG. 2, but shows another operating embodiment which may be practiced with an apparatus of the type shown in FIG. 1.
Figure 9:
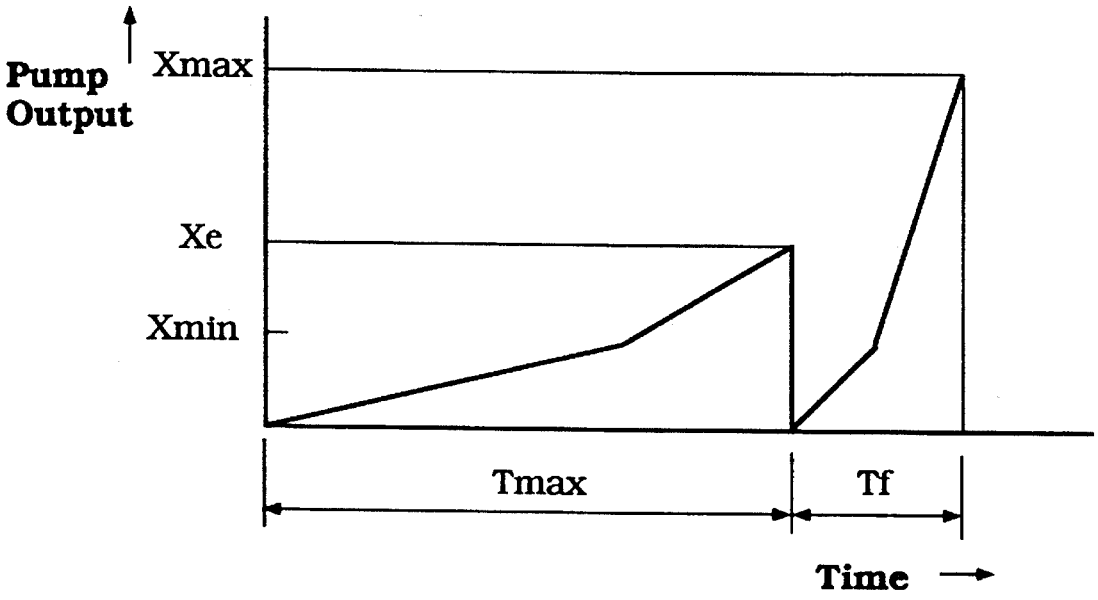
FIG. 9 is a graphical view, in part similar to FIG. 7, and shows the lubricant delivery in conjunction with this control routine.
Figure 10:
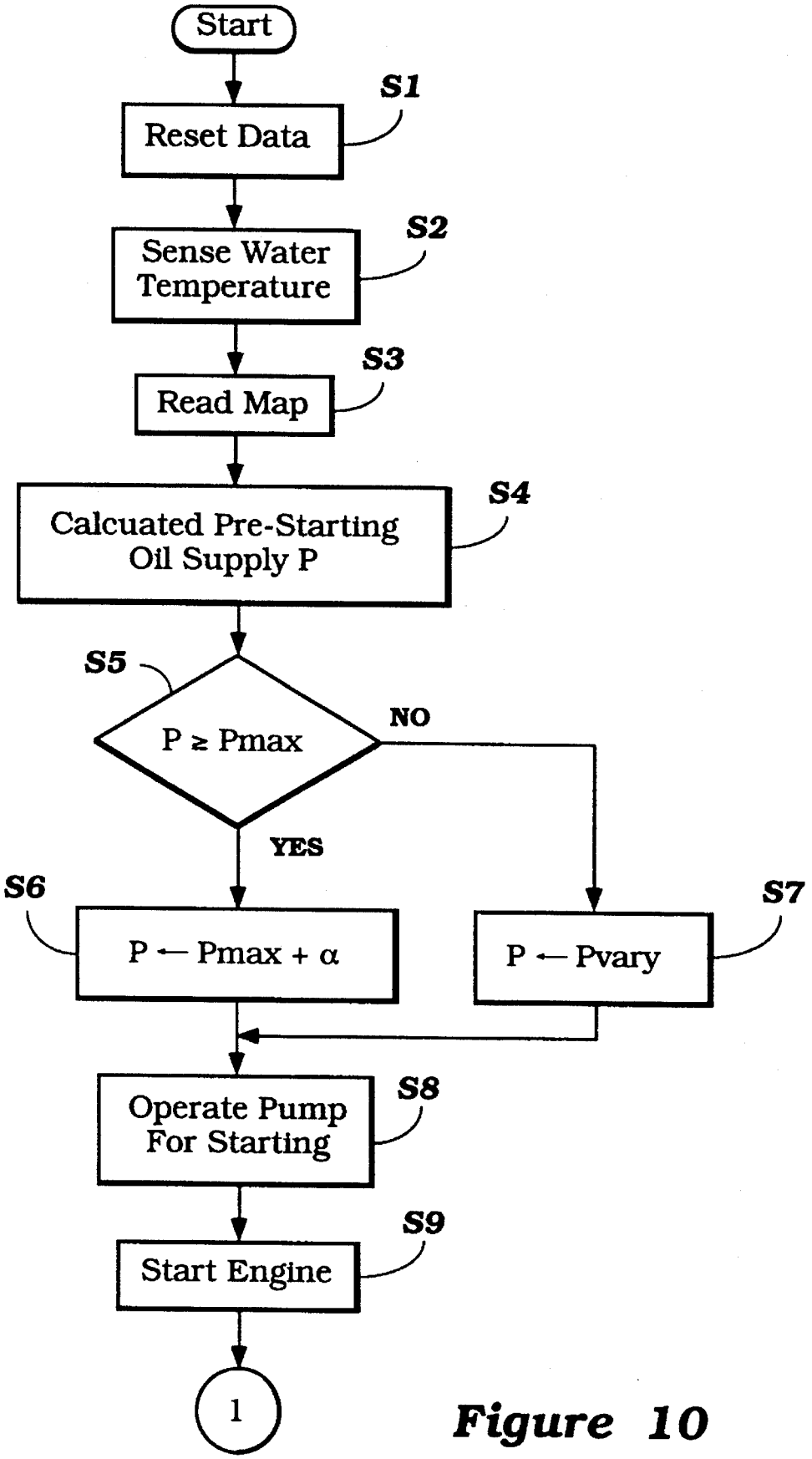
FIG. 10 is a further block diagram of the control routine of the second embodiment showing the pre-start up operation.
Figure 11:
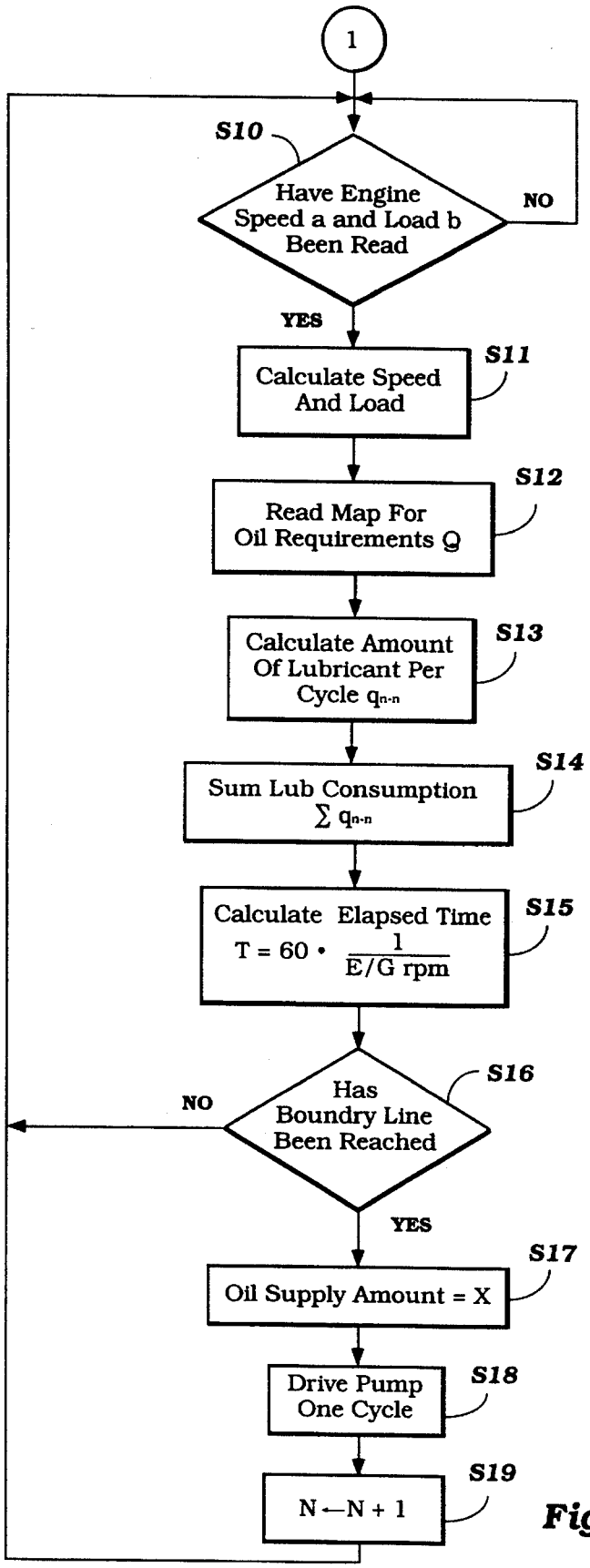
FIG. 11 is a block diagram of a further portion of the control routine showing how the lubricant supply determination are made in conjunction with this embodiment.

The control routine for this embodiment is shown in FIG. 5 generally with detailed sub-control routines being shown in FIGS. 10 and 11. However, before referring in detail to those figures, the two phases of control operation will be described by reference to FIGS. 6 and 7 and FIGS. 8 and 9.

Figure 6:
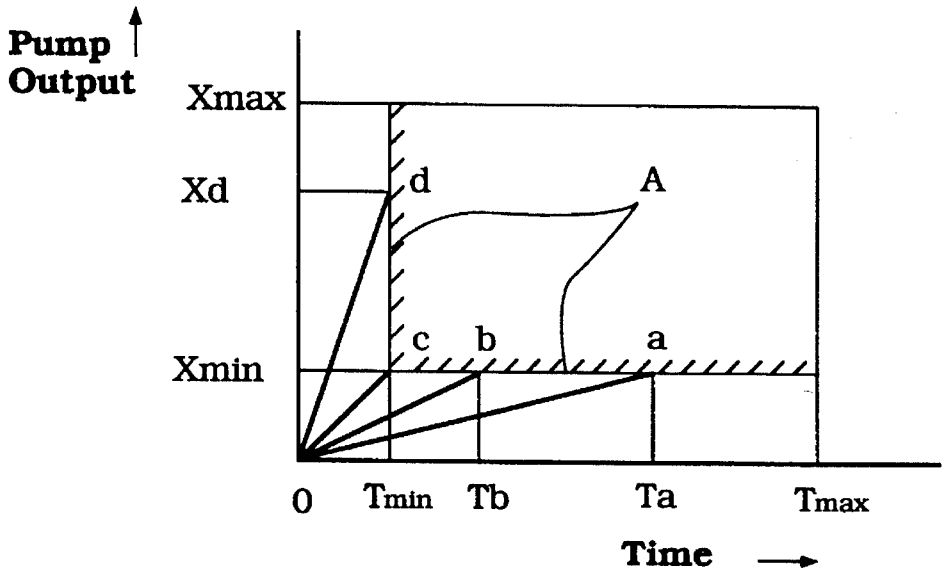
FIG. 6 is a graphical view showing a first control phase of this embodiment that is employed in conjunction with load speed, low load conditions.
Figure 7:
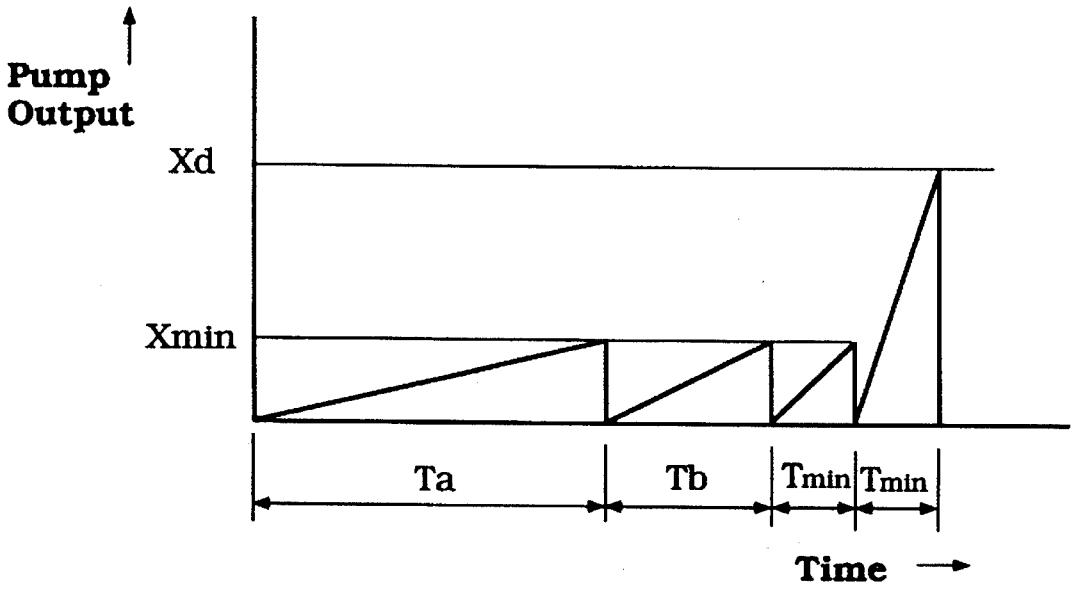
FIG. 7 is a graphical view showing how the lubricant is delivered in conjunction with this phase of operation.

FIG. 6 and 7 show the control routine when the engine is operating in a domain indicated by the boundary line "A" in FIG. 6 and at low speed, low load conditions. Under these conditions, there is provided a predetermined minimum time period "$T_{min}$" for the time between cycles, which time period is determined by the point "c" wherein the minimum displacement of the pump "$X_{min}$" will provide the requisite amount of lubricant in the minimum time "$T_{min}$". Below this time period the capacity of the pump is varied so that if the accumulated requirement "Q" exceed "$X_{min}$" before the elapsed time reaches "$T_{min}$", then "$X_d$" amount of oil is supplied by varying the pump stroke. However, if the amount of lubricant "Q" required does not reach a value greater than the minimum displacement of the pump within the "$T_{min}$" time, then the lubricant requirements are supplied by varying the time between pumped cycles between "$T_{min}$" and "$T_{max}$" as shown by the curves "a", "b" and "c" ($T_{min}$). The pump output is depicted in FIG. 7 for these various conditions of low speed, low load requirements.

Figure 8:
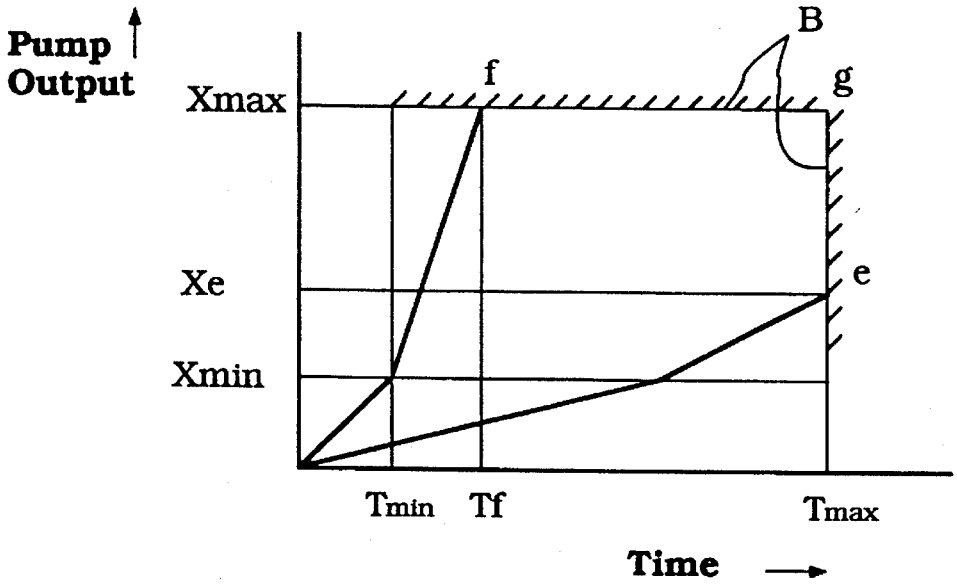
FIG. 8 is a graphical view, in part similar to FIG. 6, and shows the control routine employed during high speed, high load running conditions.

Referring now to FIGS. 8 and 9, these figures show the control strategy when operating in the domain encompassed by the zone "B" as shown in FIG. 8. This strategy is used in the high speed, high load range and oil is supplied when the elapsed time "T" reaches the longest time "$T_{max}$" or when the accumulated requirement "Q" reaches the maximum oil supply amount "$X_{max}$". For example, in the case where the elapsed time "T" reaches the longest time "$T_{max}$" before the accumulated requirement "Q" reaches the maximum oil supply amount "$X_{max}$" then the amount of oil "$X_e$" is supplied at that time as shown in this figure. The way that this is done, is that the pump is operated through its minimum stroke and then the stroke is increased so as to supply the requirements "$X_e$" in the maximum time period "$T_{max}$". In addition, if the accumulated requirements of lubricant "Q" reaches the maximum oil supply amount "$X_{max}$" before the elapsed time "T" reaches the longest time "$T_{max}$", "$X_{max}$" of oil is supplied at that time as shown by the curve "f" in the time "$T_f$".

This control routine is suitable where the interval between oil supplies is set as long as possible as indicated by the point "g" which is taken as the standard. The interval between oil supplies is shortened in the case where the accumulated requirement "Q" becomes more than "$Q_{min}$" and the oil supply amount is reduced in the cases where the accumulated requirement "Q" becomes less than "$X_{min}$". Of course, the control routine of FIGS. 6 and 7 may also be used in the high speed, high load range if so desired.

Referring now to FIG. 5, the portion of the control routine of the second embodiment will be described and this figure shows after the initial engine start-up has begun. The start-up procedure may be same as that previously described but preferably the start-up procedure as shown in FIG. 10 is employed.

Once the start-up procedure has been completed, the program moves the step S1, as with the previously described routine, so as to input the engine speed and load signals. The program then moves the step S2 so as to read the oil consumption amount map, as previously described, for the engine speed and load. At the step S3, the oil requirement per engine revolution "Q" is then determined for the then running condition. The program then moves to the step S4 so as to sum the oil consumption for the period of time being read ($Q=\Sigma_q$).

An accumulative time reading is then taken which is determined by dividing one by the engine speed in rpm at the revolution currently being read at the step S5

$$\left(T = 60 \cdot \frac{1}{Eg\ \text{rpm}}\right).$$

The program then moves to the step S6 to determine from either the control routine of FIGS. 6 and 7 or the control routine of FIGS. 8 and 9 whether the system is operating within the boundary range "A" or "B", respectively. If the boundary line has not been reached, the program moves back to the step S1 and repeats until the boundary line is reached.

If, however, at the step S6 it has been determined that the boundary line has been reached, then the program moves the step S7 to calculate the amount of lubricant required "X" and to the step S8 so as to operate the pump to supply this amount of lubricant. The program then moves to the step S9 to either reset the accumulated consumption "Q" to zero (0) or to calculate the remaining lubricant "Q" in accordance with the equation:

$$Q=\Sigma_q-X$$

The detailed control routine will be described now by particularly reference to FIGS. 10 through 17 with the start-up sequence of FIG. 10 being described first.

The program starts, as with the previously described embodiment, when the ignition key is switched on and before the engine is started. The program then moves to the step S1 so as to reset all of the data and specifically the lubricating oil accumulated requirement "$\Sigma_q$" determined at the step S14 of FIG. 11 is reset is zero (0).

The program then moves to the step S2 so as to sense the water temperature and then moves to the step S3 so as to determine the starting amount of lubricant "P" to be supplied for the read temperature. This is calculated at the step S4.

The program then moves to the step S5 to determine if the amount of lubricant required for starting equal to or greater than the maximum amount of lubricant which can be pumped by the respective pump per cycle ($P \geqq P_{max}$).

If the starting lubricant requirement "P" is greater than or equal to the maximum amount of lubricant which can be pumped at a given cycle, then the program moves to the step S6 and substitutes a value "$P_{max}+\alpha$" for the value of the total oil starting supply amount "P". This is to insure that the pump will be driven more than one time so as to supply the required amount of lubricant with the number of cycles being determined by dividing the new value of "P" by "$P_{set}$" to determine the actual number of cycles which the pump is being operated for starting.

If, however, at the step S5 it is determined that the amount of lubricant required for starting is less than the maximum per cycle capacity of the pump, the program then moves to the step S7 so as to vary the capacity of the pump so as to supply the necessary amount of lubricant "P" in a single cycle.

Once the capacity of the pump has been set in accordance with the step S7 or the number of cycles has been determined in accordance with step S6, the program moves to the step S8 so as to operate the pump for starting. The program then moves to the step S9 so as to initiate the starting operation for the engine.

Once the engine has been started or after the engine has been running, the control routine of FIG. 11 is then followed and this control routine will be described by reference to that figure. This phase of the program begins at the step S10 where it is determined if the engine speed "a" and load "b" have been read similar to the start of the routine of the first embodiment. If they have not, the program repeats.

If, however, the engine speed and load have been imputed as determined at the step S10, the program moves to the step S11 so as to actually calculate the engine speed and load. The program then moves to the step S12 to read from the map the lubricant requirements for the engine running condition with the amount "Q" begin determined by the number of cubic centimeters of lubricant per hour.

Figure 12:
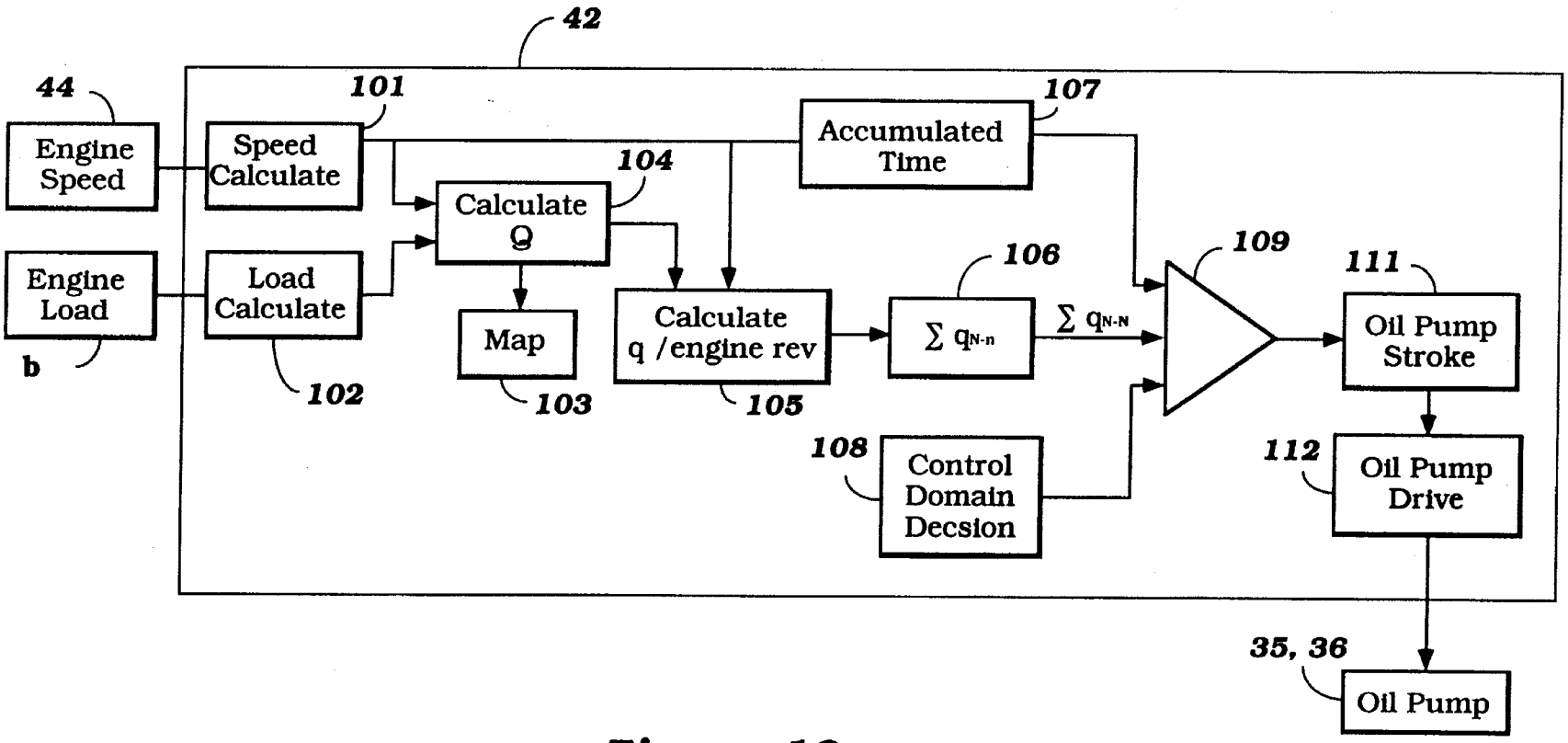
FIG. 12 is a schematic view showing the various components of the control system and their interrelationship for practicing the second embodiment.
Figure 13:
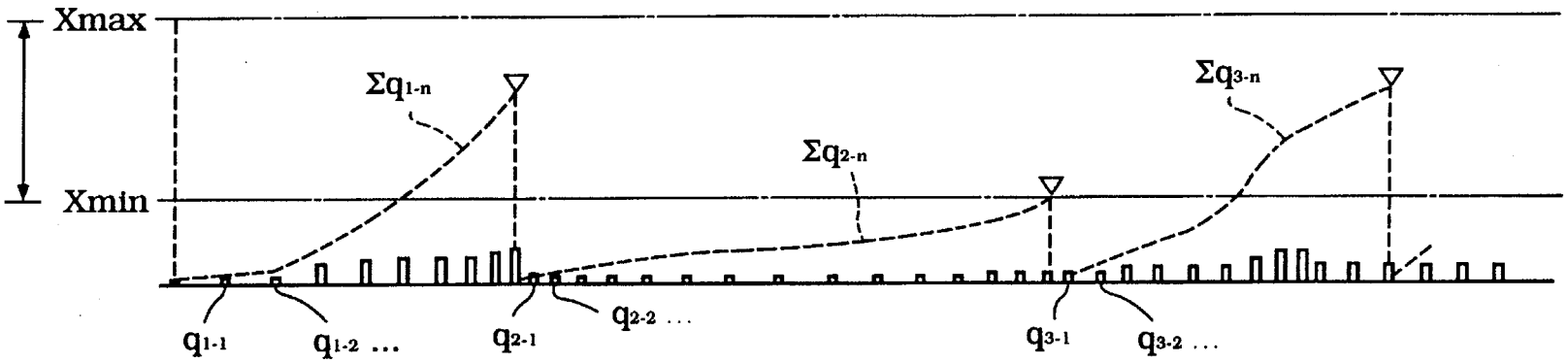
FIGS. 13 and 14 are graphically views, in part similar to FIGS. 6 and 7 for this embodiment showing the operation during a certain type of control routine practiced with this embodiment.
Figure 14:
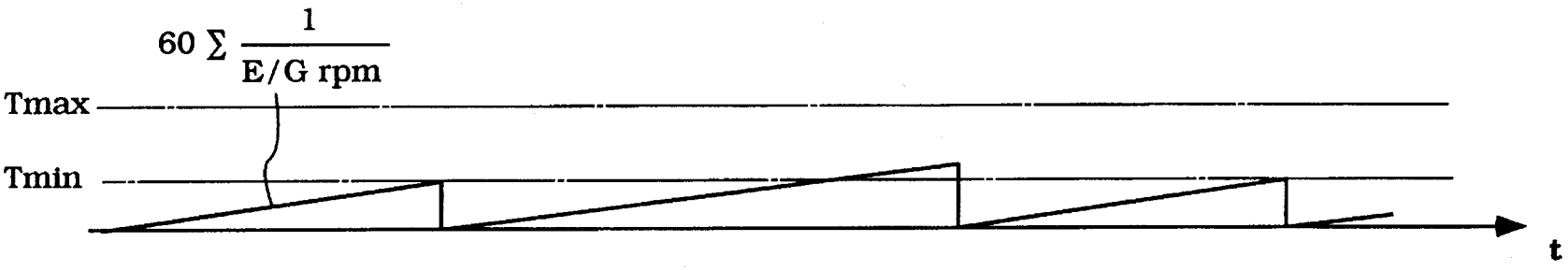

FIG. 12 shows the blocks or components of the system and particularly the control device 42 for performing this operation wherein the speed calculator is indicated by the reference numeral 101 and the load calculator indicated by the reference numeral 102 which processes the engine speed and load signals "a" and "b", respectively. The map which has the lubricant requirements for the speed and load is indicated at 103 and the calculating portion is indicated by the reference numeral 104 wherein the actual calculation is made based upon the data from the map for the engine speed and load requirements.

The program then moves to the step S13 so as to calculate the amount of lubricant consumed by the engine for that one revolution of the engine by dividing the "Q" by the engine speed and time, these totals for each cycle and are then summed at the step S15. The portions of the system which provide the calculation per revolution and the accumulation are indicated by the blocks 105 and 106, respectively in FIG. 12.

At the step S15 a time calculation is made so as to determine the accumulated time by dividing one by the sum of the engine speeds and revolutions per minute and by multiplying this by 60

$$\left(T = 60\Sigma \frac{1}{E \cdot \text{speed}}\right).$$

This time accumulation is indicated by the box 107 in FIG. 12.

The program then moves to the step S16 to determine if the oil boundary line "a" or "b" of the respective control routine curves (FIGS. 8 or 9 or FIGS. 9 and 10) has been reached. That is, if using the control routine of FIGS. 6 and 7, it is determined if either "$X_{max} \geqq \Sigma Q_{N-n} \geqq X_{min}$" and "$T_{max} \geqq T \geqq T_{min}$". If the control routine of FIG. 8 is being employed, then the boundary line is reached if the "$\Sigma q_{N-n} \geqq X_{max}$" or "$T \geqq T_{max}$". Which control routine is employed will be made by a decision derived from a control domain decision map indicated by the box 108 in FIG. 12 which determines which control routine will be followed depending upon the previously programmed information as to speed and load ranges for which each domain will apply. The control domain decision is then made by the control from the inputs from the units 106, 107 and 108 by the box decision 109 of FIG. 12.

If the boundary line of the respective control routine has not been reached, the program repeats back to the step S10. If, however, the boundary line has been reached, then the program moves to the step S17 so as to set the stroke of the respective lubricating pump so as to set the amount of lubricant to be supplied "X". The program then moves to the step S18 so as to cycle the operation of the lubricating pump. The pump is at this time driven through one cycle. The program then moves to the step S19 so as to reset "N" by adding an integer to it (N=N+1) and repeats back to the step S10.

The oil pump stroke adjusting mechanism is shown schematically in FIG. 12 at 111 while the oil pump drive is shown schematically at 112. It is to be understood that any known types of oil pumps and/or stroke adjusting mechanisms may be employed. Although preferably these pumps are driven by electric motors or pulsers, they can be driven from the engine if desired. However, engine driven pumps will not permit the delivery of lubricant to the engine prior to the actual starting of the engine as with the preferred embodiments as thus far described.

Figure 15:
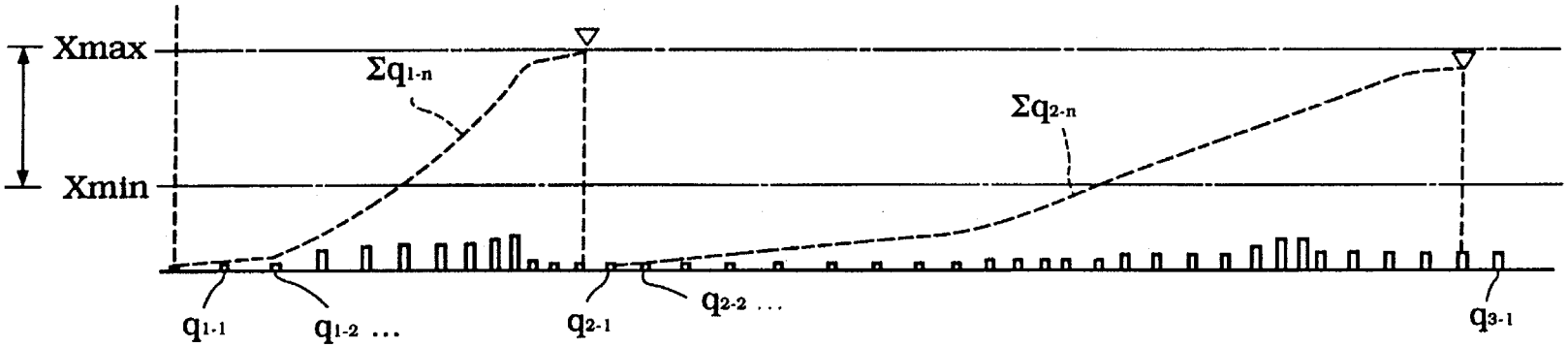
FIGS. 15 and 16 are views in part similar to FIGS. 13 and 14 of this embodiment and show another phase of operation.
Figure 16:
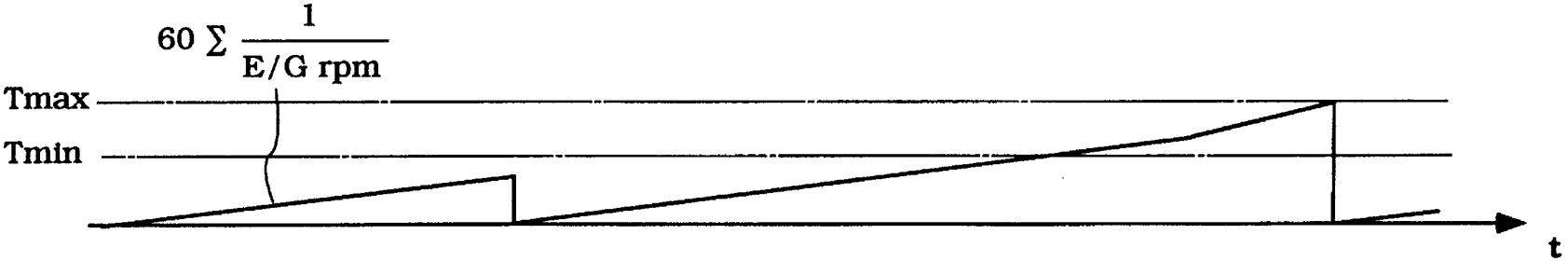

Referring now to FIGS. 13 through 16, FIG. 13 shows a series of selective pumping operations wherein the control routine according with FIGS. 6 and. 7 have been employed since the relationships of the boundary line condition "a" have not been met during any of these cycles. FIGS. 15 and 16 show two cycles of operation in accordance with the control routine embodying the diagrams of FIGS. 8 and 9 and again adequate lubrication has been provided under all varying running conditions.

Reference has been made to the incorporation of a map for determining the lubricant requirements of the engine in response to certain engine conditions, speed and load in the described embodiments. In addition, it is well known that an engine that is being run in usually requires more lubricant than an engine that has been fully broken in. Therefore, it is also possible, with either embodiment, to include an arrangement wherein the map includes two series of maps, one for an engine which has not been run in and one which is for an engine that has been run in and to include some running time input to determine which map will be employed. This running time input may be obtained by electrically accumulating engine speed, engine operating time, travel distance, etc. to determine when break-in has been completed. When break-in has been completed, then the map and calculation equations can be changed. In order to protect the system in the event the battery is disconnected, a non-volatile memory such as an EEPROM for keeping the accumulated value data or by incorporating a back up battery or the like may be employed.

Figure 17:
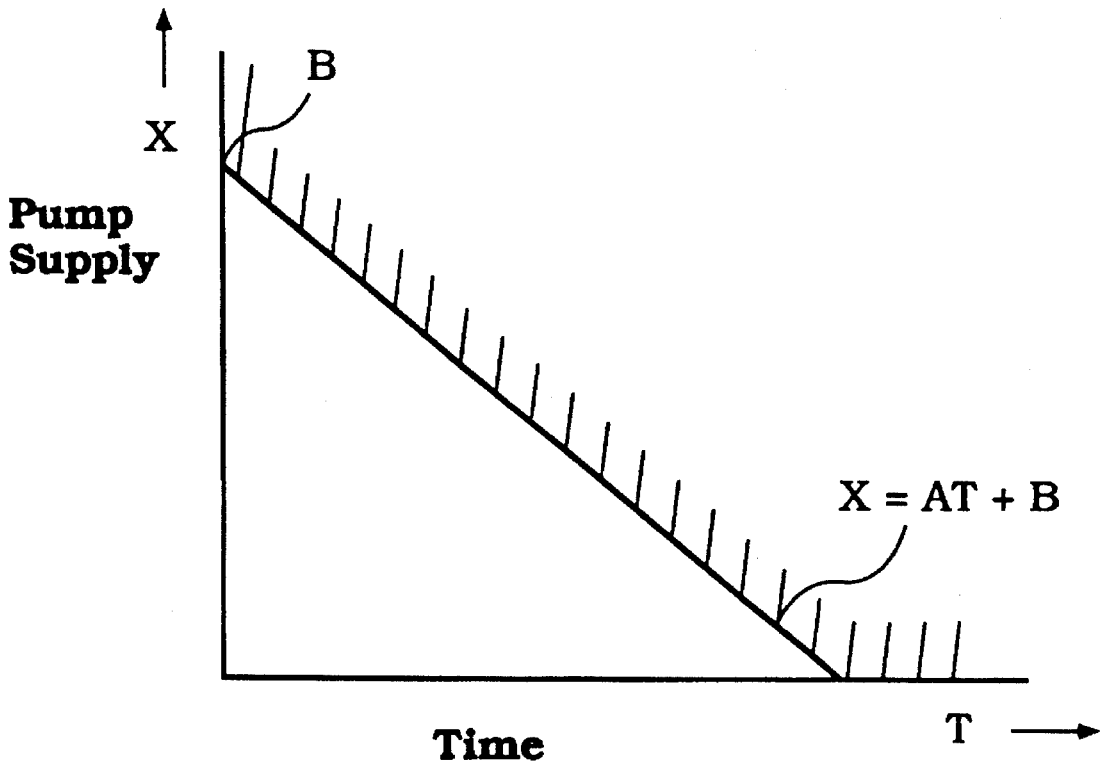
FIG. 17 is a graphically view showing how the boundary line conditions can be varied in accordance with another embodiment.

In the control routine of FIGS. 5 through 16, it has been assumed that the times "$T_{max}$" and "$T_{min}$" and the oil supply amounts "$X_{max}$" and "$X_{min}$" are constant. However, the invention may also be employed in a case where the oil supply amount is a function of time namely "X=f(T)". Where FIG. 17 shows a situation wherein these are variable but in a linear function wherein the pump output "X=AT+B". In such a case, then the decision equation can be given as "$X \geqq AT+B$" and the oil can be supplied in this case when the oiling boundary line "X" of FIG. 17 is reached.

It should be readily apparent that the foregoing description is that of preferred embodiments of the invention and various alternative control routines and sequences which can be employed. Of course, various other changes and modifications will present themself to those skilled in the art and such changes and modifications are deemed to fall within the spirit and scope of the invention, as defined by the appended claims.

We claim:

1. A lubricating system for an internal combustion engine comprising an intermittently operated lubricant pump for pumping a predetermined amount of lubricant per cycle of pump operation, means for delivering lubricant from said pump to said engine, means for sensing engine running conditions for determining the amount of lubricant consumed by said engine, and control means for operating said pump for delivering a fixed amount of lubricant to said engine and thereafter discontinuing the operation of said pump, means for reading the output of said sensing means during successive time periods and accumulating a total of the amount of lubricant consumed after a lubricant delivery by said lubricant pump and again initiating a lubricant delivery by said lubricant pump when the accumulated values of lubricant consumed by said engine reaches the predetermined amount of lubricant delivered by said pump.

2. A lubricating system as set forth in claim 1 wherein the internal combustion engine is a two cycle, crankcase compression internal combustion engine.

3. A lubricating system as set forth in claim 1 wherein the lubricant is delivered by the lubricating system directly to operating elements of the engine.

4. A lubricating system as set forth in claim 3 wherein the internal combustion engine is a two cycle, crankcase compression internal combustion engine.

5. A lubricating system as set forth in claim 4 wherein the operating elements of the engine include a crankshaft and a piston.

6. A lubricating system as set forth in claim 5 wherein there is provided a separate lubricating system for each of the crankshaft and piston each controlled by a respective control as set forth therein.

7. A lubricating system as set forth in claim 6 further including means for determining the time of running of the engine and varying the lubricant delivery in response to the time the engine has run.

8. A lubricating system as set forth in claim 7 wherein the lubricant system supplies more lubrication to the engine before it has been run for a predetermined time than after it has been run for a predetermined time for given running conditions.

9. A lubricating system as set forth in claim 1 further including means for starting the engine and means for initiating a first lubricant delivery by the lubricant system prior to operation of the means for starting the engine.

10. A lubricating system as set forth in claim 9 wherein the amount of lubricant delivered to the engine for start-up is varied in response to the temperature of the engine at the time of starting and further including means for sensing the temperature of the engine.

11. A lubricating system as set forth in claim 9 wherein the lubricant pump is operated through a plurality of cycles prior to starting.

12. A lubricating system as set forth in claim 10 wherein the internal combustion engine is a two cycle, crankcase compression internal combustion engine.

13. A lubricating system as set forth in claim 10 wherein the lubricant is delivered by the lubricating system directly to an operating element of the engine.

14. A lubricating system as set forth in claim 13 wherein the internal combustion engine is a two cycle, crankcase compression internal combustion engine.

15. A lubricating system as set forth in claim 14 wherein the operating elements of the engine includes the crankshaft and a piston.

16. A lubricating system as set forth in claim 15 wherein there is provided a separate lubricating system each of the crankshaft and piston each controlled by a respective control in accordance as set forth therein.

17. A lubricating system as set forth in claim 16 further including means for determining the time of running of the engine and varying the lubricant delivery in response to the time the engine has run.

18. A lubricating system as set forth in claim 17 wherein the lubricant system supplies more lubrication to the engine before it has been run for a predetermined time than after it has been run for the predetermined time for the same running condition.

19. A lubricating system as set forth in claim 1 wherein the lubricant pump further is operable to vary the amount of lubricant pumped during each cycle of its operation and wherein the amount of lubricant pumped is varied as well as the time before which lubricant is again supplied to the engine by operating the pump.

20. A lubricating system for an internal combustion engine comprising lubricant delivery means including a lubricant pump and electronic control means for delivering controlled variable amounts of lubricant to at least a component of said engine at successive time-spaced intervals during the running of the engine, starting means for cranking said engine for effecting rotation of said engine, and means for operating said lubricant pump and said control means to deliver only a fixed amount of lubricant to said engine component prior to the initiation of rotation of said engine by said starting means.

21. A lubricating system as set forth in claim 20 wherein the internal combustion engine is a two cycle, crankcase compression internal combustion engine.

22. A lubricating system as set forth in claim 21 wherein the lubricant is delivered by the lubricating delivery means directly to an operating element of the engine.

23. A lubricating system as set forth in claim 22 wherein the internal combustion engine is a two cycle, crankcase compression internal combustion engine.

24. A lubricating system as set forth in claim 23 wherein the operating elements of the engine includes the crankshaft and a piston.

25. A lubricating system as set forth in claim 20 wherein the fixed amount of lubricant delivered to the engine for start-up is varied in response to the temperature of the engine at the time of starting and further including means for sensing the temperature of the engine.

26. A lubricating system as set forth in claim 25 wherein the lubricant delivery system lubricant pump is operated through a plurality of fixed delivery cycles prior to initiation of operation of the starting means.

27. A lubricating system as set forth in claim 26 wherein the internal combustion engine is a two cycle, crankcase compression internal combustion engine.

28. A lubricating system for an internal combustion engine comprising a lubricant delivery system for supplying lubricant to said engine, sensing means for sensing instantaneous engine running conditions, timer means for sensing the total time said engine has been operated, and control means for controlling the supply of lubricant to said engine in response to both sensed engine running conditions and sensed total time the engine has been run.

29. A lubricating system as set forth in claim 28 wherein the internal combustion engine is a two cycle, crankcase compression internal combustion engine.

30. A lubricating system as set forth in claim 28 wherein the lubricant is delivered by the lubricating system directly to an operating element of the engine.

31. A lubricating system as set forth in claim 30 wherein the internal combustion engine is a two cycle, crankcase compression internal combustion engine.

32. A lubricating system as set forth in claim 31 wherein the operating elements of the engine includes the crankshaft and pistons.

33. A lubricating system as set forth in claim 32 wherein there is provided a separate lubricating system for each of the crankshaft and the piston each controlled by a respective control in accordance with the method set forth therein.

34. A lubricating system as set forth in claim 33 wherein the lubricant system supplies more lubricant to the engine before it has been run a predetermined total time than after the predetermined time.

35. A lubricating system as set forth in claim 28 wherein the lubricant system supplies more lubricant to the engine before it has been run for a predetermined total time than after that predetermined time.

36. A lubricating system for an internal combustion engine having first and second operating elements, a first lubricating system for delivering lubricant to said first operating element, a second lubricating system for delivering lubricant to said second operating element, means for sensing engine running conditions, first control means for controlling said first lubricant system in response to sensed engine conditions independent of said second lubricating system, and second control means for controlling said second lubricating system in response to sensed engine running conditions and independently of said first lubricating system.

37. A lubricating system as set forth in claim 36 wherein the internal combustion engine is a two cycle, crankcase compression internal combustion engine.

38. A lubricating system as set forth in claim 37 wherein the operating elements of the engine includes the crankshaft and a piston.

39. A lubricating system as set forth in claim 38 further including means for starting the engine and means for initiating a first lubricant delivery by at least one of the lubricant systems prior to operation of the means for starting the engine.

40. A lubricating system as set forth in claim 39 wherein the amount of lubricant delivered to the engine for start-up is varied in response to the temperature of the engine at the time of starting and further including sensing the temperature of the engine.

41. A lubricating method as set forth in claim 40 wherein the lubricant pump is operated through a plurality of cycles prior to starting.

42. A lubricating method for an internal combustion engine comprising an intermittently operated lubricant pump for pumping a predetermined amount of lubricant per cycle of pump operation, means for delivering lubricant from said pump to said engine, said method comprising the steps of sensing engine running conditions for determining the amount of lubricant consumed by said engine, operating said pump for delivering a fixed amount of lubricant to said engine and thereafter discontinuing the operation of said pump, determining the incremental amount of lubricant consumed during successive time periods from the sensed running conditions and accumulating a total of the amount of lubricant consumed after a lubricant delivery by said lubricant pump, and again initiating a lubricant delivery by said lubricant pump when the accumulated values of lubricant consumed by said engine reaches the fixed predetermined amount of lubricant delivered by said pump.

43. A lubricating method as set forth in claim 42 wherein the internal combustion engine is a two cycle, crankcase compression internal combustion engine.

44. A lubricating method as set forth in claim 42 wherein the lubricant is delivered by the lubricating system directly to an operating element of the engine.

45. A lubricating method as set forth in claim 44 wherein the internal combustion engine is a two cycle, crankcase compression internal combustion engine.

46. A lubricating method as set forth in claim 45 wherein the operating elements of the engine includes the crankshaft and a piston.

47. A lubricating method as set forth in claim 46 wherein there is provided a separate lubricating system for the crankshaft and for the piston, respectively, each controlled by a respective control in accordance with the method set forth therein.

48. A lubricating method as set forth in claim 47 further including means for determining the time of running of the engine and varying the lubricant delivery in response to the time the engine has run.

49. A lubricating method as set forth in claim 48 wherein more lubricant is supplied to the engine before it has been run for a predetermined time than after it has run for the predetermined time for the same running condition.

50. A lubricating method as set forth in claim 42 further including means for starting the engine and the first lubricant delivery by the lubricant system is initiated prior to operation of the means for starting the engine.

51. A lubricating method as set forth in claim 50 wherein the amount of lubricant delivered to the engine for start-up is varied in response to the temperature of the engine at the time of starting and further including the step of sensing the temperature of the engine.

52. A lubricating method as set forth in claim 50 wherein the lubricant pump is operated through a plurality of cycles prior to starting.

53. A lubricating method as set forth in claim 51 wherein the internal combustion engine is a two cycle, crankcase compression internal combustion engine.

54. A lubricating method as set forth in claim 51 wherein the lubricant is delivered by the lubricating system directly to an operating element of the engine.

55. A lubricating method as set forth in claim 54 wherein the internal combustion engine is a two cycle, crankcase compression internal combustion engine.

56. A lubricating method as set forth in claim 55 wherein the operating elements of the engine includes the crankshaft and a piston.

57. A lubricating method as set forth in claim 56 wherein there is provided a separate lubricating system for the crankshaft and for the piston, respectively, each controlled by a respective control in accordance with the method set forth therein.

58. A lubricating method as set forth in claim 57 further including the steps of determining the time of running of the engine and varying the lubricant delivery in response to the time the engine has run.

59. A lubricating method as set forth in claim 58 wherein the lubricant system supplies more lubricant to the engine before it has been run for a predetermined time than after it has run for the predetermined total time.

60. A lubricating method as set forth in claim 42 wherein the lubricant pump further is operable to vary the amount of lubricant pumped during each cycle of its operation and wherein the amount of lubricant pumped is varied in addition to the time during which lubricant is again supplied to the engine by operating the pump.

61. A lubricating method for an internal combustion engine comprising lubricant delivery means including a lubricant pump and electronic control means for delivering controlled variable amounts of lubricant to at least a component of said engine at successive time-spaced intervals during its running, starting means for cranking said engine for effecting rotation of said engine, said method comprising operating said lubricant pump and said control means to deliver only a fixed amount of lubricant to said engine component prior to the initiation rotation of said engine by said starting means.

62. A lubricating method as set forth in claim 61 wherein the internal combustion engine is a two cycle, crankcase compression internal combustion engine.

63. A lubricating method as set forth in claim 62 wherein the lubricant is delivered by the lubricating system directly to an operating element of the engine.

64. A lubricating method as set forth in claim 63 wherein the internal combustion engine is a two cycle, crankcase compression internal combustion engine.

65. A lubricating method as set forth in claim 23 wherein the operating elements of the engine includes the crankshaft and a piston.

66. A lubricating method as set forth in claim 61 wherein the fixed amount of lubricant delivered to the engine for start-up is varied in response to the temperature of the engine at the time of starting and further including the steps of sensing the temperature of the engine.

67. A lubricating method as set forth in claim 66 wherein the lubricant pump is operated through a plurality of cycles prior to initiation of operation of the starting means.

68. A lubricating method as set forth in claim 66 wherein the internal combustion engine is a two cycle, crankcase compression internal combustion engine.

69. A lubricating method for an internal combustion engine comprising a lubricant delivery system for supplying lubricant to said engine, said method comprising the step of sensing engine running conditions, sensing the total elapsed time when said engine has been run and for controlling the supply of lubricant to said engine in response to both sensed engine running conditions and sensed total elapsed time the engine has run.

70. A lubricating method as set forth in claim 69 wherein the internal combustion engine is a two cycle, crankcase compression internal combustion engine.

71. A lubricating method as set forth in claim 69 wherein the lubricant is delivered by the lubricating system directly to an operating element of the engine.

72. A lubricating method as set forth in claim 71 wherein the internal combustion engine is a two cycle, crankcase compression internal combustion engine.

73. A lubricating method as set forth in claim 72 wherein the operating elements of the engine includes the crankshaft and a piston.

74. A lubricating method as set forth in claim 73 wherein there is provided a separate lubricating system for the crankshaft and for the pistons, respectively, each controlled by a respective control in accordance with the method set forth therein.

75. A lubricating method as set forth in claim 74 further including determining the time of running of the engine and varying the lubricant delivery in response to the time the engine has run.

76. A lubricating method as set forth in claim 75 wherein the lubricant system supplies more lubricant to the engine before it has run for a predetermined time than after that predetermined time.

77. A lubricating method as set forth in claim 69 wherein the lubricant system supplies more lubricant to the engine before it has run for a predetermined time than after that predetermined time.

78. A lubricating method for an internal combustion engine having first and second operating elements, a first lubricating system for delivering lubricant to said first operating element, a second lubricating system for delivering lubricant to said second operating element, said method comprising sensing engine running conditions, controlling said first lubricant system in response to sensed engine conditions independent of said second lubricating system, and controlling said second lubricating system in response to sensed engine running conditions and independently of said first lubricating system.

79. A lubricating method as set forth in claim 78 wherein the internal combustion engine is a two cycle, crankcase compression internal combustion engine.

80. A lubricating method as set forth in claim 78 wherein the operating elements of the engine includes the crankshaft and a piston.

81. A lubricating method as set forth in claim 79 further including means for starting the engine and initiating a first lubricant delivery by one of the lubricant systems prior to operation of the means for starting the engine.

82. A lubricating method as set forth in claim 81 wherein the amount of lubricant delivered to the engine for start-up is varied in response to the temperature of the engine at the time of starting and sensing the temperature of the engine.

83. A lubricating method as set forth in claim 82 wherein the lubricant pump is operated through a plurality of cycles prior to starting.

* * * * *